US009088847B2

(12) United States Patent
Young-Mun

(10) Patent No.: US 9,088,847 B2
(45) Date of Patent: Jul. 21, 2015

(54) EAR TIP AND METHOD OF MANUFACTURING THE SAME AND EAR PHONE INCLUDING THE SAME

(71) Applicant: APK Co., Ltd., Yongin-si, Gyeonggi-do (KR)

(72) Inventor: Yoon Young-Mun, Seongnam-si (KR)

(73) Assignee: APK Co., Ltd., Yongin-si (KR)

( * ) Notice: Subject to any disclaimer, the term of this patent is extended or adjusted under 35 U.S.C. 154(b) by 0 days.

(21) Appl. No.: 14/023,895

(22) Filed: Sep. 11, 2013

(65) Prior Publication Data

US 2014/0166389 A1 Jun. 19, 2014

(30) Foreign Application Priority Data

Oct. 24, 2012 (KR) ..... 10-2012-0118204

(51) Int. Cl.
*H04R 25/02* (2006.01)
*H04R 1/10* (2006.01)
*H04R 25/00* (2006.01)

(52) U.S. Cl.
CPC ..... *H04R 1/1016* (2013.01); *H04R 1/1058* (2013.01)

(58) Field of Classification Search
USPC ..... 181/135, 130, 131; 381/328, 380; 128/867; 264/255, 295, 294, 279
See application file for complete search history.

(56) References Cited

U.S. PATENT DOCUMENTS 4,870,689 A * 9/1989 Weiss ..... 381/325
5,044,463 A * 9/1991 Carr ..... 181/135
5,799,658 A * 9/1998 Falco ..... 128/864
5,988,313 A * 11/1999 H.ang.kansson ..... 181/135
6,256,396 B1 * 7/2001 Cushman ..... 381/328
6,513,621 B1 * 2/2003 Deslauriers et al. ..... 181/130
6,659,103 B2 * 12/2003 Tiemens ..... 128/864
7,192,544 B2 * 3/2007 Jenkins et al. ..... 264/46.4
7,602,933 B2 * 10/2009 Cartwright et al. ..... 381/380
7,837,005 B2 * 11/2010 Killion ..... 181/129
7,841,446 B2 * 11/2010 Leong et al. ..... 181/135
8,101,103 B2 * 1/2012 Tiemens et al. ..... 264/46.9
8,107,638 B2 * 1/2012 Zwislocki ..... 381/72
8,113,207 B2 * 2/2012 Gehling et al. ..... 128/864
8,194,911 B2 * 6/2012 Dyer et al. ..... 381/382
8,312,960 B2 * 11/2012 Keady ..... 181/135
8,343,397 B2 * 1/2013 Woo et al. ..... 264/46.4
8,348,010 B2 * 1/2013 Stiehl et al. ..... 181/130
8,625,834 B2 * 1/2014 Smith et al. ..... 381/380
8,666,085 B2 * 3/2014 Donaldson et al. ..... 381/71.6
8,679,607 B2 * 3/2014 Hamer et al. ..... 428/36.5
8,761,424 B2 * 6/2014 Wubker et al. ..... 381/325
2003/0029460 A1 * 2/2003 Tiemens ..... 128/864
2003/0173144 A1 * 9/2003 Werblud ..... 181/131
2004/0066939 A1 * 4/2004 Wong ..... 381/67
2006/0233411 A1 * 10/2006 Utigard ..... 381/328
2011/0051979 A1 * 3/2011 Lee et al. ..... 381/380
2013/0188819 A1 * 7/2013 Young-Mun ..... 381/380
2014/0014121 A1 * 1/2014 Endle et al. ..... 128/867
2014/0230830 A1 * 8/2014 Hamer et al. ..... 128/867

* cited by examiner

*Primary Examiner* — Edgardo San Martin
(74) *Attorney, Agent, or Firm* — Fildes & Outland, P.C.

(57) ABSTRACT

In an ear tip and a method of manufacturing the same, the ear tip includes a sound transfer part including a hollow shaft and an external sheet and an acoustic absorbent making contact with the external sheet and the hollow shaft. The hollow shaft has a cylindrical shape of which a circumferential surface is flat and provides a sound conduit for transferring audio signals. The external sheet is extended from an end portion of the hollow shaft in such a way that the hollow shaft is enclosed with the external sheet and a gap space is provided between the external sheet and the hollow shaft. The acoustic absorbent is positioned in the gap space and has a plurality of pores, thereby absorbing surrounding noises and preventing the surrounding noises from transferring into user's ear.

15 Claims, 6 Drawing Sheets

EAR TIP AND METHOD OF MANUFACTURING THE SAME AND EAR PHONE INCLUDING THE SAME

BACKGROUND

1. Field

Example embodiments of the present invention relate to an ear tip and method of manufacturing the ear tip and an ear phone including the same, and more particularly, to an ear tip having silicone foam and a method of manufacturing the same, and an ear phone including the ear tip having the silicone foam.

2. Description of the Related Art

Various headphones have been used for listening audio signals in a single mode or for listening high quality of the audio signals. Particularly, as mobile devices such as a smart phone and a tablet PC have been widely used in a recent time, there have been plenty of chances and needs for individually listening the audio signals such as many pieces of music and lecture files without any external noises and disturbances from surroundings. For those reasons, high sealed and fidelity headphones are now in great demand.

Conventional ear phones includes a body for converting electrical signals to sounds or the audio signals and an ear tip detachably coupled to the body and making contact with an ear skin of the users. The body usually comprises hard materials such as hard polymer and metal and includes some grooves and stepped portions at an end portion for reinforcing the coupling between the body and the ear tip.

The ear tip usually includes a sound conduit coupled to the groove and the stepped portion of the body and transferring the sound into the user's ear there through and a external sheet extending from an end portion of the sound conduit and surrounding the sound conduit in such a configuration that the external sheet makes close contact with the skin of an auditory canal of the user's ear and the user's ear hole is covered with the external sheet. Thus, an internal ear and an external ear are separated from each other in the user's ear and the environmental noises are usually prevented from being transferred into the internal ear from surroundings. Since the external sheet makes direct contact with the user's skin in the ear, the external sheet usually plays a key role for comfortable and natural usage and high degree of noise-proofing of the ear phone. Particularly, urethane foam is usually provided in a gap space between the sound conduit and the external sheet of the conventional ear tip so as to protect the environmental noises.

FIG. 1 is a perspective view illustrating a conventional ear tip having urethane foam and FIG. 2 is a perspective view illustrating the urethane foam of the ear tip shown in FIG. 1.

Referring to FIG. 1 and FIG. 2, a conventional ear tip 10 having an acoustic absorbent 3 is usually manufactured by inserting urethane foam into the gap space of the ear tip and the urethane foam is formed by an additional process irrespective of the process for manufacturing a naked ear tip having no urethane foam. A foam body comprising urethane may be provided through a foaming process and the foam body is cut into a plurality of cylindrical acoustic absorbent pieces 31 by a cutting process and a piece process. Then, a central hole is provided at a central portion of the acoustic absorbent piece 31 and a form tube 32 is secured into the central hole, to thereby form the acoustic absorbent 3. The external sheet 1 of the naked ear tip is turned over and the sound conduit 2 is exposed and then the sound conduit 2 is inserted into the form tube 32 of the acoustic absorbent 3.

Thereafter, the external sheet 1 is restored to cover the acoustic absorbent 3 to thereby form the conventional ear tip 10.

However, since the external sheet 1 comprises silicone (Si) and the acoustic absorbent 3 comprises urethane, the external sheet 1 is not sufficiently adhered to the acoustic absorbent 3 and thus the acoustic absorbent 3 is frequently separated from the external sheet 1. For that reason, a protrusion or a stepped portion, which is frequently protruded from the sound conduit 2 toward the external sheet 1 in the gap space between the sound conduit 2 and the external sheet 1, is additionally provided at an end portion of the sound conduit 2 so as to prevent the separation of the external sheet 1 and the acoustic absorbent 3. In addition, the urethane foam has insufficient flexibility and thus is much more irritating to the user's ear than flexible foam. Further, the foaming process and cutting process for the acoustic absorbent piece are usually performed to every individual absorbent piece, which causes reduce the process efficiency of the ear tip and increase the manufacturing cost of the ear tip.

Accordingly, there is still a need for an improved ear tip and a method of manufacturing the ear tip by which the surrounding noises are sufficiently shut off without any feelings of irritations to the user's ear.

SUMMARY

Example embodiments of the present inventive concept provide a method of manufacturing an ear tip in which silicone foam having sufficient flexibility is directly inserted by a single molding process.

Example embodiments of the present inventive concept also provide an ear tip having the silicone foam manufactured by the above process.

Example embodiments of the present inventive concept also provide an ear phone including the above ear tip.

According to an aspect of the present invention, there is provided an ear tip including a sound transfer part including a hollow shaft and an external sheet and an acoustic absorbent. The hollow shaft may have a cylindrical shape of which a circumferential surface may b flat and may provide a sound conduit for transferring audio signals. The external sheet may be extended from an end portion of the hollow shaft in such a way that the hollow shaft may be enclosed with the external sheet and a gap space may be provided between the external sheet and the hollow shaft. The acoustic absorbent may make contact with the external sheet and the hollow shaft in the gap space and may have a plurality of pores. The acoustic absorbent may absorb surrounding noises and prevent the surrounding noises from transferring into user's ear.

In an example embodiment, the acoustic absorbent may include silicone foam and the external sheet and the hollow shaft may include a silicone rubber. The hollow shaft and the external sheet may have a durometer of 25° to 40° and the silicone foam may have a durometer of 5° to 25°.

In an example embodiment, the hollow shaft and the external sheet may have a durometer of 50° to 60° and the silicone foam has a durometer of 5° to 25°.

According to another aspect of the present invention, there is provided a method of manufacturing the ear tip. A sound transfer part including a hollow shaft and an external sheet may be firstly provided for manufacturing the above ear tip. The hollow shaft may have a cylindrical shape of which a circumferential surface may be flat and provide a sound conduit for transferring audio signals. The external sheet may be extended from an end portion of the hollow shaft in such a way that the hollow shaft may be enclosed with the external sheet and a gap space may be provided between the external sheet and the hollow shaft. The sound transfer part may be combined with a lower mold including at least a first recess in such a way that the gap space ma be exposed to surroundings. Then, an upper mold may be combined to the lower mold in such a way that the gap space may be covered with the upper mold and the upper mold may have a preliminary acoustic absorbent having a plurality of pores. The preliminary acoustic absorbent may be extruded into the gap space of the sound transfer part by applying an extrusion pressure to the preliminary acoustic absorbent, thereby forming an acoustic absorbent in the gap space of the sound transfer part. The upper mold may be separated from the lower mold, thereby exposing the sound transfer part having the acoustic absorbent, and then the sound transfer part having the acoustic absorbent may be separated from the lower mold.

In an example embodiment, the sound transfer part may be combined with the lower mold as follows. The lower mold may be formed to have a first plate-shaped mold body on which the first recess is prepared in such a way that a pillar may be protruded from a central bottom of the first recess and a ring-shaped receiving space may be provided around the pillar. The sound transfer part may be secured into the first recess in such a way that the pillar may be inserted into the hollow shaft of the sound transfer part and the external sheet may be received in the receiving space around the pillar.

In an example embodiment, the sound transfer part may be secured into the first recess by a combine zig.

In an example embodiment, a plurality of the first recesses may be provided on the lower mold, so that a number of the sound transfer parts may be simultaneously secured into the first recesses, respectively.

In an example embodiment, the upper mold may be combined to the lower mold as follows. The upper mold may be formed to have a second plate-shaped mold body on which a second recess may be provided correspondently to the first recess. The upper mold may include at least an extrusion gate penetrating through the second mold body from a bottom of the second recess to a rear surface of the second mold body and communicating with the second recess. A mixture of solid state silicone and a thermally-decomposed foaming agent may be supplied into the second recess of the second mold body. Then, the second mold body may be aligned with the first mold body in such a way that the extrusion gate may be positioned over the gap space of the sound transfer part that may be secured to the first recess of the first mold body. The second mold body may be moved downwards to the first mold body until the rear surface of the second mold body may make contact with an upper surface of the first mold body.

In an example embodiment, the upper mold may be formed to further have at least a ring-shaped protrusion protruded from the rear surface of the second mold body along the ring-shaped receiving space of the first recess, and the step of moving the second mold body downwards may be performed until the ring-shaped protrusion may be inserted into an upper portion of the gap space and thus an upper portion of the gap space may be covered with the ring-shaped protrusion.

In an example embodiment, the extrusion gate may penetrate through both of the second mold body and the ring-shaped protrusion, so that the second recess may be communicated with the extrusion gate.

In an example embodiment, the preliminary acoustic absorbent may be extruded into the gap space as follows. A pressure cover including a pressure plate and a pressurizing protrusion protruded from a rear surface of the pressure plate may be combined with the upper mold in such a way that the pressurizing protrusion may be inserted into the second recess of the upper mold. Silicone foam may be formed as the preliminary acoustic absorbent by performing a heat treatment to the mixture of the solid state silicone and the foaming agent in the second recess. The preliminary acoustic absorbent may be pressurized by the pressurizing protrusion, thereby extruding the preliminary acoustic absorbent into the gap space of the sound transfer part through the extrusion gate.

In an example embodiment, the step of forming the silicone foam as the preliminary acoustic absorbent and the step of pressurizing the preliminary acoustic absorbent may be simultaneously performed, so that the silicone foam may be formed from the mixture while being extruded into the gap space.

In a modified example embodiment, the upper mold may be combined to the lower mold as follows. The upper mold may be formed to have a second plate-shaped mold body on which a second recess may be provided correspondently to the first recess. The upper mold may include at least an extrusion gate penetrating through the second mold body from a bottom of the second recess to a rear surface of the second mold body and communicating with the second recess. Silicone foam as the preliminary acoustic absorbent may be supplied into the second recess of the upper mold body. Then, the second mold body may be aligned with the first mold body in such a way that the extrusion gate may be positioned over the gap space of the sound transfer part that may be secured to the first recess of the first mold body. The second mold body may be moved downwards to the first mold body until the rear surface of the second mold body may make contact with an upper surface of the first mold body.

According to still another aspect of the present invention, there is provided an ear tip including the above ear tip. The ear phone includes a housing including an audio signal generator, a cover detachably coupled to the housing such that the housing may be covered with the cover and an inner space of the housing may be closed from surroundings and an ear tip detachably attached to the cover. The cover may include a sound guide through which the audio signal may be discharged out of the closed inner space and the ear tip may guide the audio signals into the user's ear. The ear tip may include a sound transfer part including a hollow shaft and an external sheet and an acoustic absorbent making contact with the external sheet and the hollow shaft. The hollow shaft may have a cylindrical shape of which a circumferential surface may be flat and may provide a sound conduit for transferring audio signals. The external sheet may be extended from an end portion of the hollow shaft in such a way that the hollow shaft may be enclosed with the external sheet and a gap space may be provided between the external sheet and the hollow shaft. The acoustic absorbent may be positioned in the gap space and may have a plurality of pores, thereby absorbing surrounding noises and preventing the surrounding noises from transferring into user's ear.

In a modified example embodiment, the sound guide may be shaped into a tube having at least a recess and at least a protrusion at an end portion thereof and the hollow shaft of the ear tip may include a stepped unit having a receiving space in which the protrusion may be received in such a configuration that the protrusion and the stepped unit may make surface contact with each other in an axial direction of the hollow shaft.

According to example embodiments of the present inventive concept, the acoustic absorbent including silicone foam is directly formed in the gap space between the external sheet and the hollow shaft of the sound transfer part by a molding process, rather than combining the sound transfer part and the acoustic absorbent after forming the acoustic absorbent by an additional process irrespective of the sound transfer part. Particularly, the replace of the conventional urethane foam by the flexible silicone foam sufficiently improves the shutoff of the surrounding noises and mitigates the feelings of irritation to the user's ear. In addition, the adhesion between the silicone foam and the external sheet of the sound transfer part is much stronger than that between the conventional urethane foam and the external sheet, and thus the protrusions for securing the acoustic absorbent to the sound transfer part are not needed any more, to thereby increasing the manufacturing efficiency of the ear tip.

BRIEF DESCRIPTION OF THE DRAWINGS

Example embodiments will be more clearly understood from the following detailed description taken in conjunction with the accompanying drawings.

DETAILED DESCRIPTION OF THE EMBODIMENTS

Figure 1:
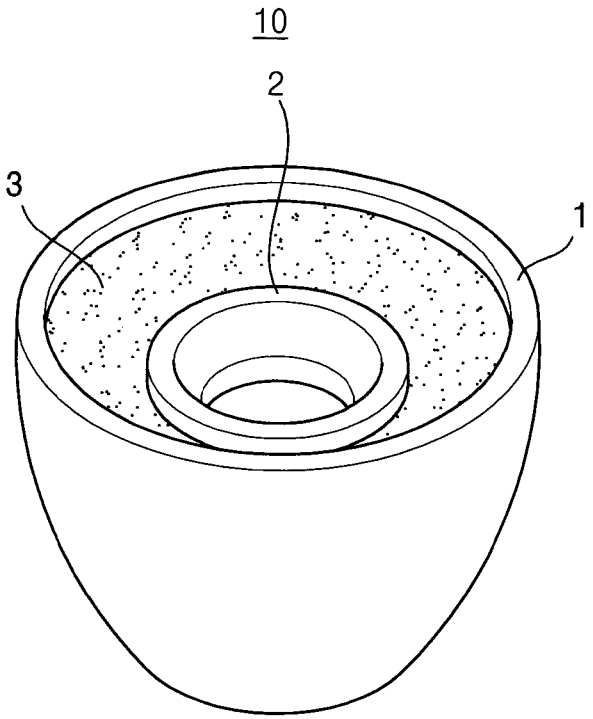
FIG. 1 is a perspective view illustrating a conventional ear tip having urethane foam.
Figure 2:
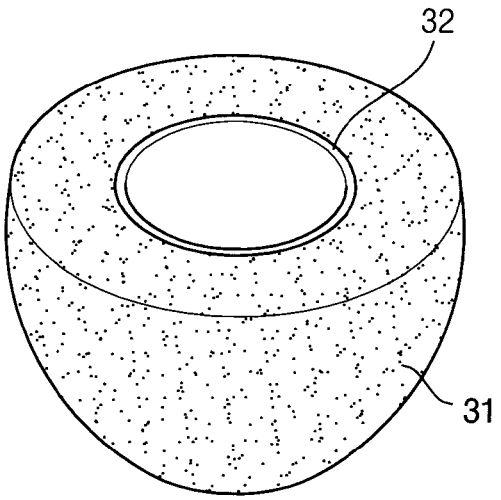
FIG. 2 is a perspective view illustrating the urethane foam of the ear tip shown in FIG. 1.

Various example embodiments will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 3:
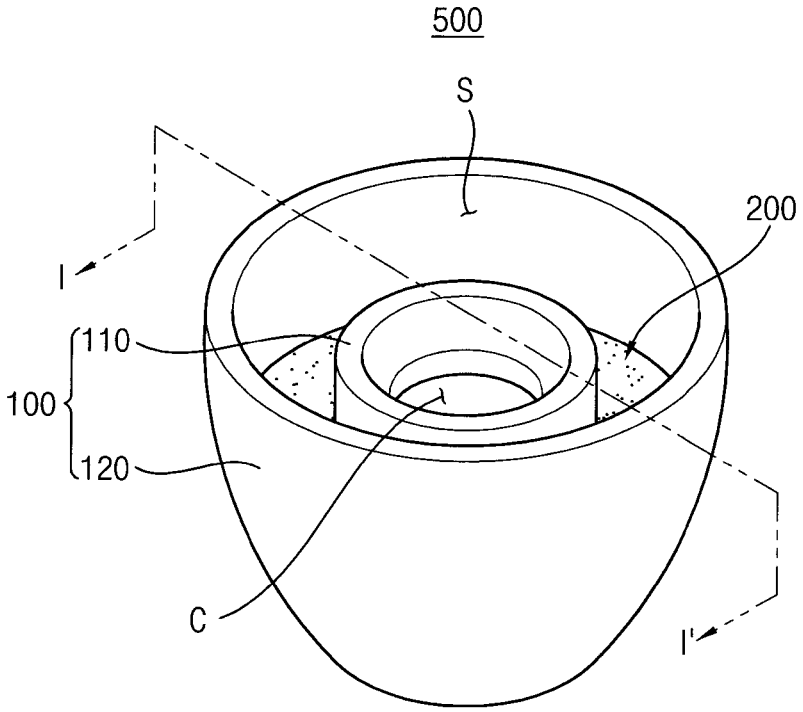
FIG. 3 is a perspective view illustrating an ear tip in accordance with an example embodiment of the present invention.
Figure 4:
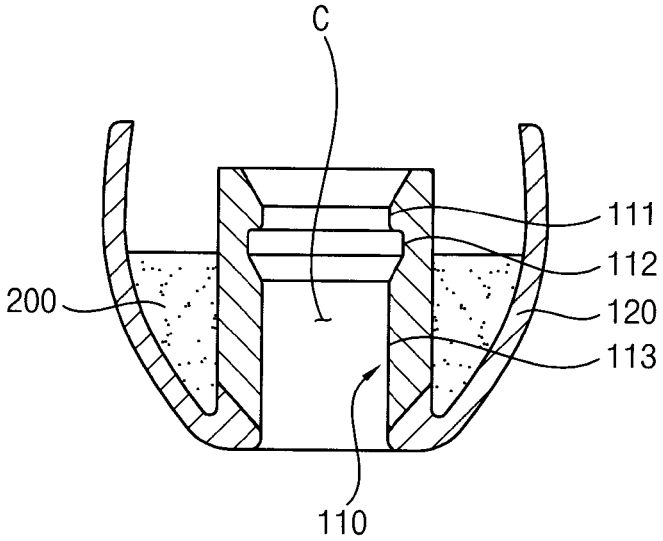
FIG. 4 is a cross-sectional view cut along a line I-I' of FIG. 3.

FIG. 3 is a perspective view illustrating an ear tip in accordance with an example embodiment of the present invention, and FIG. 4 is a cross-sectional view cut along a line I-I' of FIG. 3.

Referring to FIGS. 3 and 4, an ear tip 500 in accordance with an example embodiment of the present inventive concept may include a sound transfer part 100 for transferring audio signals and an acoustic absorbent 200 for blocking or shutting off surrounding noises.

In an example embodiment, the sound transfer part 100 may include a hollow shaft 110 having a cylindrical sound conduit C through which the audio signals may be transferred and an external sheet 120 extending from an end portion of the hollow shaft 110 and enclosing the hollow shaft 100 in such a configuration that a gap space S may be provided between the hollow shaft 110 and the external sheet 120.

For example, the hollow shaft 110 may be shaped into a liner cylinder having a predetermined length and a penetration hole may be provided through the hollow shaft 110 for transferring the audio signals. The penetration hole passing through the hollow shaft 110 may function as the sound conduit C. Thus, a first end portion of the hollow shaft 110 may be coupled to a body of an ear phone (not illustrated) in which the audio signals may be generated from electrical signals, and a second end portion opposite to the first end portion of the hollow shaft 110 may be inserted into a user's ear. Thus, the sound conduit C may be communicated with an inner space of the user's ear.

For example, the hollow shaft 110 may include a guide unit 111 for guiding a connector unit (not illustrated) of the ear phone body to the hollow shaft 110, a stepped unit 112 to which the connector unit of the ear phone body may be coupled to thereby prevent the separation of the hollow shaft 110 and the connector unit and a conduit body 113 for transferring the audio signals into the user's ear.

In the present example embodiment, the guide unit 111, the stepped unit 112 and the conduit body 113 may be sequentially connected with one another and be integrally formed into one body. The guide unit 111 may be shaped into a trapezoidal cylinder in which cross-sectional circular surfaces may have different diameters along the central axis of the hollow shaft 110. Thus, the connector unit of the ear phone body may smoothly slide into the guide unit 111 at the first end portion of the hollow shaft 110 and may be pushed along the guide unit 111 until the connector unit may be coupled to the stepped unit 112. The stepped unit 112 may be shaped into a cylinder of which the diameter of the cross-sectional circular surface may be larger than those of the neighboring the guide unit 111 and the conduit body 113. Therefore, once the connector unit of the ear phone body may be coupled to the stepped portion 112 of the hollow shaft 110, the hollow shaft 110 and the connector unit of the ear phone body may be difficult to be separated from each other. That is, the connector unit of the ear phone body may be separated from the hollow shaft 110 just merely on condition that an external force may be applied to the ear phone body and the ear tip 500 over the frictional force between the stepped unit 110 and the connector unit of the ear phone body. The conduit body 113 may determine an overall shape of the hollow shaft 130 and have a sufficient durometer for reflecting the audio signals even though the audio signals or the sounds may have a relatively high frequency. The conduit body 113 may be connected to the external sheet 120 at the second end portion of the hollow shaft 110.

Particularly, protrusions or stepped portions for preventing the separation of the acoustic absorbent 200 from the hollow shaft 110 and the external sheet 120 may not be provided at the circumferential surface of the guide unit 111. Since the acoustic absorbent 200 may include silicone foam, the acoustic absorbent 200 may be sufficiently adhered to the external sheet 120 comprising silicone (Si). As a result, additional protrusions or stepped portions for preventing the separation of the acoustic absorbent 120 may not be needed in the ear tip 500. Accordingly, the ear tip 500 may be manufactured by a simplified process, thereby improving the manufacturing efficiency.

The external sheet 120 may extend from an end portion of the conduit body 113 toward the guide unit 111 and may be spaced apart from the hollow shaft 110 by a gap distance in such a configuration that the hollow shaft 110 may be enclosed by the external sheet 120. Thus, the gap space S may be provided between the hollow shaft 110 and the external sheet 120. Since the external sheet 120 may be connected with the hollow shaft 110 at the second end portion, the gap space S may be closed from surroundings around the second end portion of the hollow shaft 110 and may be open around the first end portion of the hollow shaft 110. That is, the external sheet 120 may be shaped into a pot in which the hollow shaft 110 may be positioned at a central portion thereof. In addition, the external sheet 120 may make contact with the skin in the user's ear and thus may have a profile corresponding to a normal ear hole.

In the present example embodiment, the external sheet 120 may have the same materials as the hollow shaft 110. For example, the external sheet 120 may comprise a soft silicone gel or a rubber to thereby improve contact stability with respect to the skin and reduce the irritating feelings in the ear hole. The external sheet 120 and the hollow shaft 110 may have the same material and may be integrally formed in one body. Particularly, the hollow shaft 110 may have a thickness larger than that of the external sheet 120, thus the sound may be sufficiently well reflected from the sound conduit C and the irritating feelings between the skin and the external sheet 120 may be minimized in the ear hole. In the present example embodiment, the hollow shaft 110 and the external sheet 120 may have the same durometer in a range of about 20° to about 40° and include the same material such as silicone rubber.

Otherwise, the hollow shaft 110 may include a relatively hard silicone rubber for improving sound transfer characteristics and the external sheet 120 may include a relatively soft silicone rubber for improving the irritating feelings in the user's ear.

The external sheet 120 may be inserted into the ear hole and make contact with the skin of the user's ear, thus the flexibility rather than durometer may be required to the external sheet 120 so as to improve adaptability of the ear tip 500 in the ear hole. In contrast, since the sound or the audio signals may be transferred to the ear through the sound conduit C, the sound wave may be required to be well reflected from an inner surface of the sound conduit C. For that reason, the durometer rather than the flexibility may be required to the hollow shaft 120 so as to improve the quality of the sound through the ear phone. In the present example embodiment, the hollow shaft 110 may comprise relatively hard materials and the external sheet 120 may comprise relatively soft materials, and thus the functions of the hollow shaft 110 and the external sheet 120 may be maximized, respectively, to thereby improve the sound transfer characteristics and the comfort and stability of the ear tip 500 in the user's ear.

For example, the hollow shaft 110 may comprise silicone rubber having the durometer of about 50° to about 60°, and the external sheet 120 may comprise silicone rubber having the durometer of about 5° to about 25°.

In an example embodiment, the acoustic absorbent 200 may include silicone foam having a plurality of pores and sufficient flexibility and the gap space S may be sufficiently filled up with the silicone foam. The silicone foam may absorb the surrounding noises and thus the surrounding noises may be prevented from transferring into the user's ear. The hollow shaft 110 may transfer the surrounding noises as well as the audio signals, and thus the noises transferring through the hollow shaft 110 may be minimized so as to improve sound quality of the ear phone.

The acoustic absorbent 200 may enclose the hollow shaft 110 at a bottom portion of the pot-shaped gap space S and may extend upwards making contact with the external sheet 120, and thus the surrounding noises may be sufficiently prevented from transferring through the hollow shaft 110 by the acoustic absorbent 200. Particularly, the acoustic absorbent including the silicone foam may comprise the same material of silicone as the hollow shaft 110 and the external sheet 120, and thus the acoustic absorbent 120 may be sufficiently well adhered to both of the hollow shaft 110 and the external sheet 120. In addition, the silicone foam may have sufficiently small durometer to absorb the surrounding noises.

In the present example embodiment, the silicone foam may have the durometer of about 5° to about 25° and may have a plurality of the pores and thus the surroundings noises may be sufficiently absorbed by the silicone foam. In addition, the silicone foam may have sufficient resilience and flexibility, to thereby facilitate the restoration of the ear tip 500 even when the ear tip 500 may be distorted by external forces.

When the urethane foam is provided in the gap space of the conventional ear tip for shutting off the surrounding noises, the adherence characteristics of the urethane foam to the external sheet comprising silicone may be deteriorated in the conventional ear tip and thus the urethane foam may be easily separated from the conventional ear tip. For minimizing the separation of the urethane foam from the conventional ear tip, the protrusions or stepped portions are provided at the guide unit of the hollow shaft.

However, silicone foam is provided in the gap space S of the ear tip 500 in place of the urethane foam as the acoustic absorbent 200 and thus the adherence characteristics between the acoustic absorbent 200 and both of the external sheet 120 and the hollow shaft 110 may be sufficiently improved in the ear tip 500 without any protrusions or the stepped portions, thereby improving the manufacturing efficiency of the ear tip 500. In addition, since the silicone foam may be much more flexible than the urethane foam, the surrounding noises may be more efficiently shut off from the user's ear and may reduce the irritating feelings in the user's ear. Particularly, the silicone foam may have much more shut off characteristics of the surrounding noises than the urethane foam.

Figure 5:
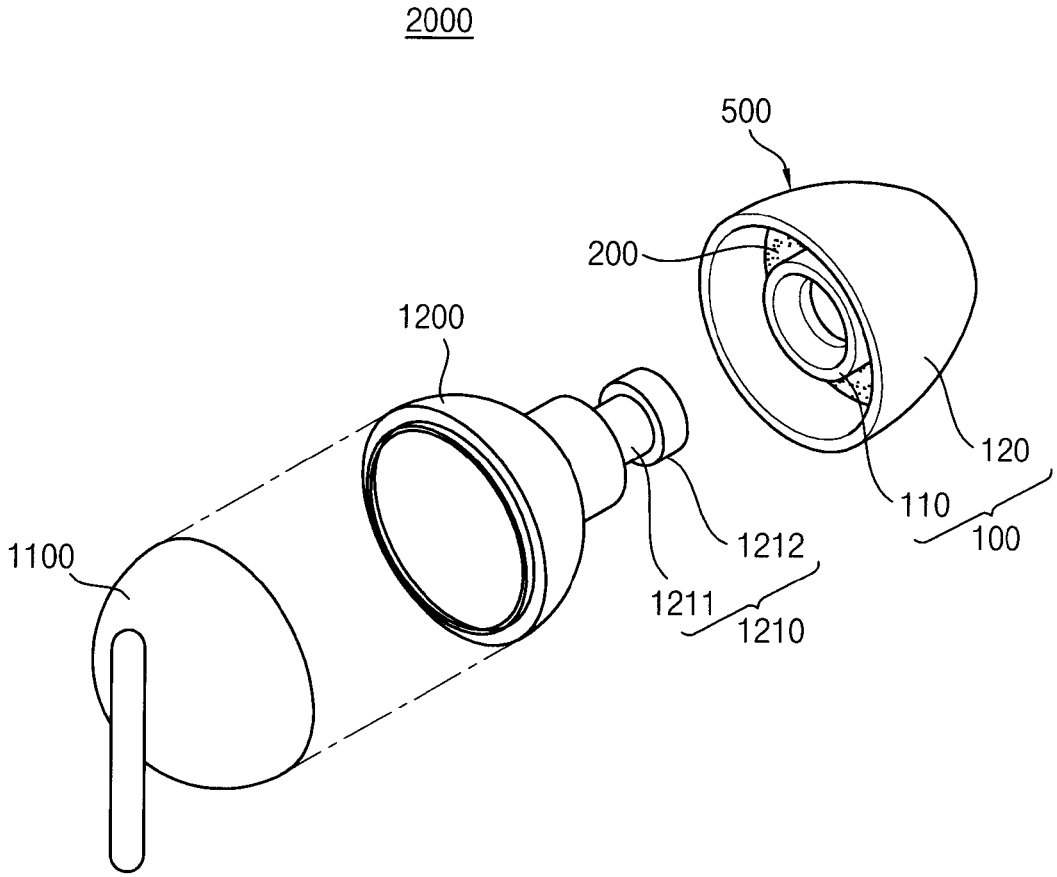
FIG. 5 is an explosive perspective view illustrating an ear phone including an ear tip in accordance with an example embodiment of the present inventive concept.

FIG. 5 is an explosive perspective view illustrating an ear phone including an ear tip in accordance with an example embodiment of the present inventive concept.

Referring to FIG. 5, an ear phone 2000 in accordance with an example embodiment of the present inventive concept may include a housing 1100 including an audio signal generator (not illustrated), a cover 1200 detachably coupled to the housing 1100 such that the housing 1100 is covered with the cover 1200 and an inner space of the housing 1100 is isolated from surroundings and an ear tip 500 detachably attached to the cover 1200 and guiding the audio signals into the user's ear.

For example, a transducer for transforming electronic/electrical signals into the audio signals may be arranged in the housing 1100 and thus the audio signals may be generated by using vibrations of metal plates. The electronic/electrical signals may be transferred to the transducer by various sound systems. Various drivers such as a permanent magnet, an electromagnet and a piezoelectricity device may be further arranged in the housing 1100 in accordance with the sound quality.

The cover 1200 may be detachably coupled to the housing 1100 and thus the inner space of the housing 1100 may be sealed from surroundings. The audio signal generator including transducer and the driver may be secured in the housing 1100 by the cover 1200. A sound guide 1210 may be installed to the cover 1200 and the sound or the audio signals in the housing 1100 may be discharged out of the closed inner space of the housing 1100. For example, the sound guide 1210 may be shaped into a tube and may include a recess 1211 and a protrusion 1212 that may be coupled to the ear tip 1300 at an end portion thereof.

The ear tip 500 may be detachably coupled to the cover 1200 in the medium of the sound guide 1210 and may be inserted into the user's ear hole. The surrounding noises may be sufficiently shut off from the user's ear and the irritating feelings may be remarkably reduced by the ear tip 500. The ear tip 500 may have the same structures and configurations as described in detail with reference to FIGS. 3 and 4, and thus any further detailed descriptions on the ear tip 500 is omitted.

When the ear phone 2000 having the ear tip 500 may be inserted into the user's ear hole, the irritating feelings to the user's ear may be reduced and the wearing sensations may be improved since the external sheet 120 and the acoustic absorbent 200 may include the same silicone rubber having high flexibility. In addition, although distorted by the external forces, the ear tip 500 may be easily restored due to the superior resilience of the external sheet 120 and the acoustic absorbent 200. Particularly, the silicone foam may be provided in the gap space S between the external sheet 120 and the hollow shaft 110, the surrounding noises may be sufficiently absorbed by the pores of the silicone foam, thereby preventing the surrounding noises from transferring into the user's ear and increasing the sound quality of the ear phone 2000.

Figure 6:
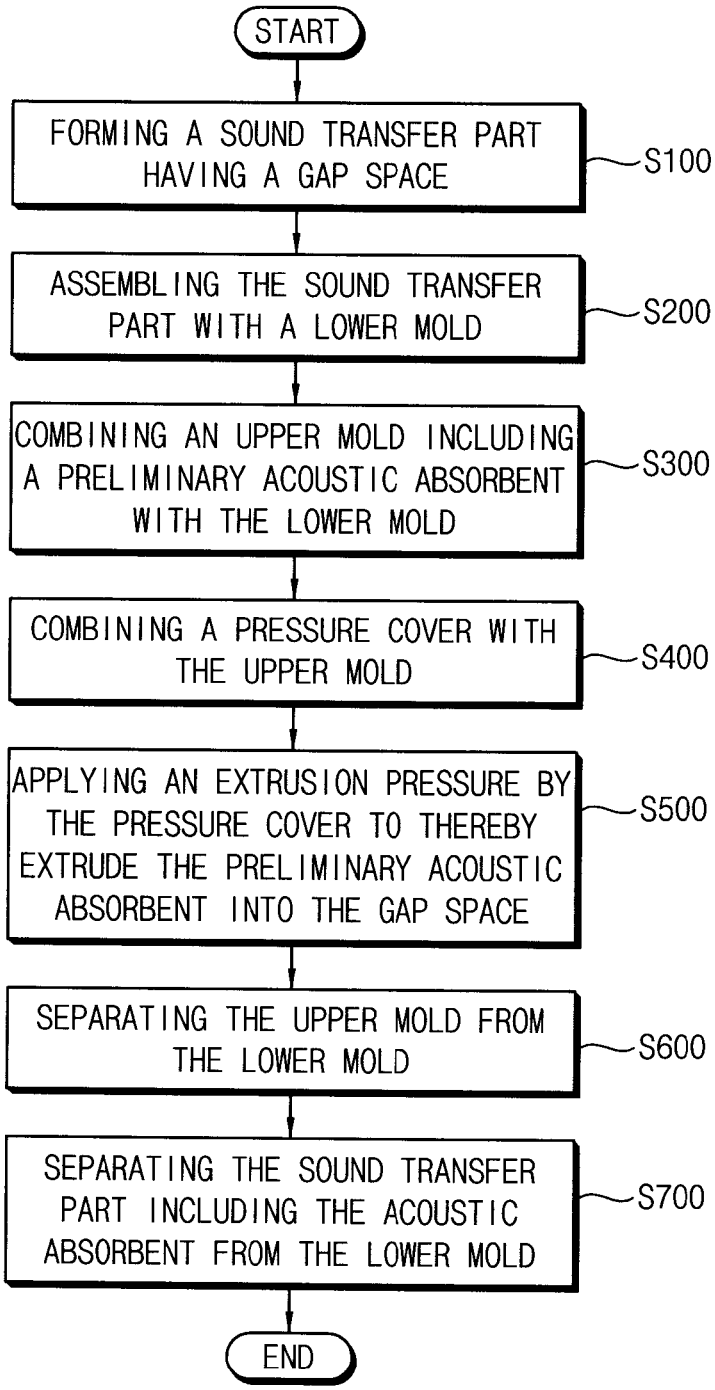
FIG. 6 is a flow chart showing a method of manufacturing the ear tip shown in FIG. 3 in accordance with an example embodiment of the present inventive concept.
Figure 7:
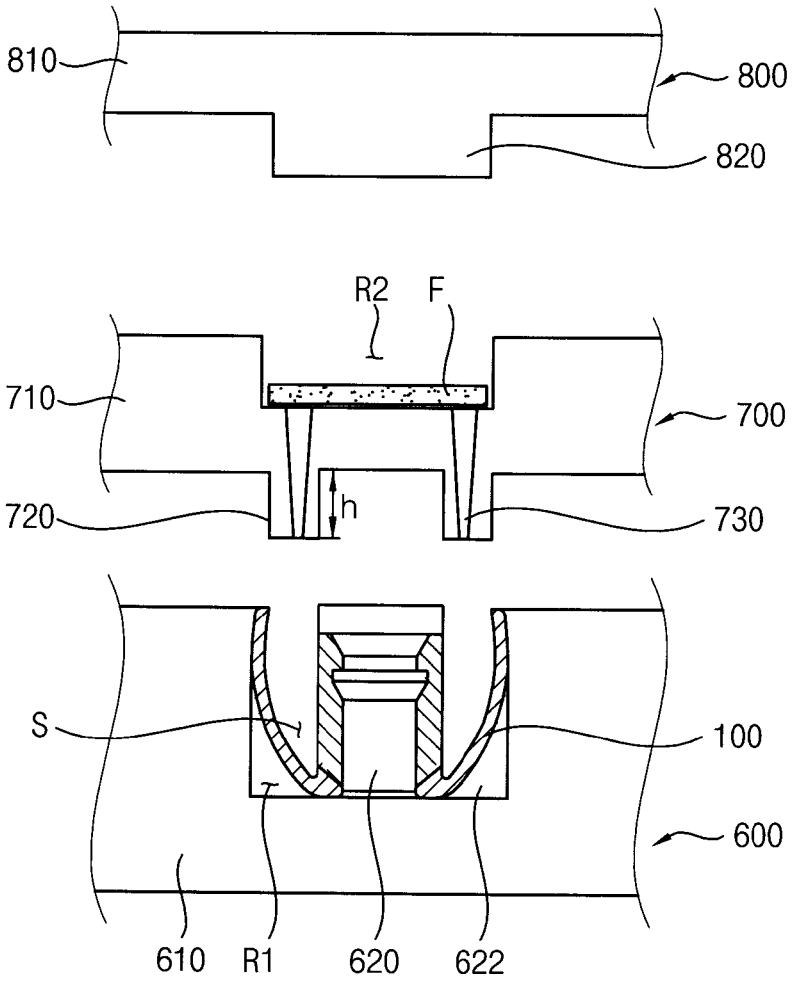
FIG. 7 is a split structural view illustrating a molding apparatus for performing the method shown in FIG. 6.
Figure 8:
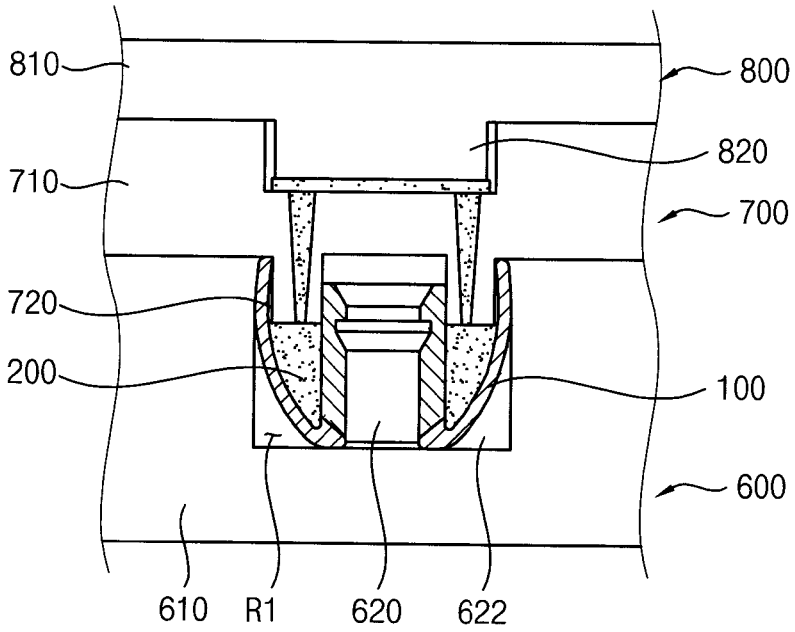
FIG. 8 is a combined structural view of the molding apparatus shown in FIG. 7.

FIG. 6 is a flow chart showing a method of manufacturing the ear tip shown in FIG. 3 in accordance with an example embodiment of the present inventive concept. FIG. 7 is a split structural view illustrating a molding apparatus for performing the method shown in FIG. 6. FIG. 8 is a combined structural view of the molding apparatus shown in FIG. 7.

Referring to FIGS. 3 and 6 to 8, the sound transfer part 100 may be formed in a previous process in such a configuration that the sound transfer part 100 may include the hollow shaft 100 for a sound conduit C through which the audio signals may be transferred and the external sheet 120 reversely extending from an end portion of the hollow shaft 110 in such a configuration that the hollow shaft 110 may be enclosed by the external sheet 120 and thus the gap space S may be provided between the hollow shaft 110 and the external sheet 120.

For example, the hollow shaft 110 and the external sheet 120 may have the same durometer or the external sheet 120 may have the durometer smaller than the hollow shaft 110. The hollow shaft 110 and the external sheet 120 may be individually formed by a respective process and may be combined to each other, to thereby form the sound transfer part 100. Otherwise, the hollow shaft 110 and the external sheet 120 may be integrally formed in a body.

Then, the sound transfer part 100 may be assembled with a lower mold 600 having a first recess R1 in such a way that the gap space S may be exposed to surroundings (step S200).

For example, the lower mold 600 may include a first mold body 610 shaped into a plate and having the first recess R1 at a central portion of an upper surface thereof. A pillar may be positioned on a central bottom of the first recess R1 and thus a ring-shaped receiving space 622 may be provided around the pillar 620 in the first recess R1 of the lower mold 600. The sound transfer part 100 may be assembled with the lower mold 600 in such a way that the pillar 620 may be inserted into the hollow shaft 110 and thus the external sheet 120 may be received in the receiving space 622.

As illustrated in FIG. 7, the lower mold 600 may include the first mold body 610 and the first recess R1 may have a size corresponding to the sound transfer part 100 and the pillar 620 may be protruded from the central bottom of the first recess R1. Since the pillar 620 may have a width smaller than that of the first recess R1 and thus the residuals of the inner space of the first recess R1 except the pillar 620 may be formed into a ring-shaped space around the pillar 620.

Therefore, when the pillar 620 may be inserted into the hollow shaft 110 of the sound transfer part 100, the external sheet 120 extending from the end portion of the hollow shaft 110 may be automatically received in the ring-shaped space of the first recess R1. Thus, the sound transfer part 100 may be secured into the first recess R1 of the lower mold 600, thereby assembling the sound transfer part 100 with the lower mold 600. That is, the ring-shaped space around the pillar 620 may be provided as the receiving space 622 for receiving the external sheet 120 of the sound transfer part 100.

Accordingly, the gap space S between the hollow shaft 110 and the external sheet 120 may be included into the receiving space 622. That is, the receiving space 622 may include an upper space corresponding to the gap space S that may be defined by the external sheet 120 and may be exposed to an upper portion of the first recess R1 and a lower space corresponding to a residual space that may be defined by the external sheet 120 and the bottom and sidewall of the first recess R1. Hereinafter, the upper space of the receiving space 622 is often referred to as the gap space S of the sound transfer unit and the lower space of the receiving space 622 is often referred to as the residual space.

The number of the first recess R1 may be varied according to the size of the first mold body 610 and the size of the upper mold 700 described in detail herein.

Since the external sheet 120 of the sound transfer part 100 may be shaped into a pod, the receiving space 622 may have a proper profile for receiving the pod-shaped external sheet 120. For example, the first recess R1 may include a circular recess having a circular cross-sectional surface and the pillar 620 may be shaped into a circular rod protruded upwards from the central bottom of the first circular recess R1. Thus, the gap distance between the circular rod and a sidewall of the circular recess R1 may be substantially the same in all directions, and the receiving space 622 around the pillar 620 may be shaped into a ring of which the diameter may be substantially the same in all directions. Accordingly, the external sheet 120 having a circular cross-sectional surface may be uniformly received in the receiving space 622 in all directions.

In contrast, the first recess R1 may include a rectangular having a rectangular cross-sectional surface and the pillar 620 may be shaped into a circular rod protruded upwards from the central bottom of the first rectangular recess R1. In such a case, the first recess R1 and the pillar 620 may be formed in such a configuration that a minimal distance between the pillar 620 and a sidewall of the rectangular recess R1 may be larger than a gap distance between the hollow shaft 110 and the external sheet 120, to thereby facilitate the assembly of the sound transfer part 100 and the lower mold 600.

The assembly of the sound transfer part 100 and the lower mold 600 may be performed by inserting the pillar 620 into the hollow shaft 110. When a plurality of the first recesses R1 may be provided with the lower mold 600, the sound transfer part 100 may be individually assembled with each of the first recesses R1 or a number of the sound transfer parts 100 may be simultaneously assembled with a number of the first recesses R1 in view of the manufacturing efficiency. For example, a plurality of the first recesses R1 may be provided on the upper surface of the first mold body 610 and a number of the sound transfer parts 100 may be simultaneously transferred over the first mold body 610. Then, the sound transfer parts 100 may be simultaneously located to the first recesses R1, respectively, by a combining tool in such a way that each pillar 620 of the first recesses R1 may be inserted into the respective hollow shaft 110 of the sound transfer parts 100.

For example, a combine zig may used for the simultaneous location of the sound transfer parts 100 into the respective first recess R1 in which the combine position of the sound transfer unit 100 may be automatically detected on the first mold body 610 according to a rectangular coordinate system.

Then, an upper mold 700 including the acoustic absorbent may be combined with the lower mold 600 (step S300).

In an example embodiment, the upper mold 700 may include a second mold body 710 having a plate shape, and a second recess R2 corresponding to the first recess R1 may be provided on an upper surface of the second mold body 710. A hole penetrating through the second mold body 710 may be provided at a bottom of the second recess R2, thereby forming an extrusion gate 730. Thus, the extrusion gate 730 may be arranged on a rear surface of the second mold body 710 and may be communicated with the second recess R2. A preliminary acoustic absorbent F may be provided in the second recess R2 of the second mold body 710.

The upper surface of the second mold body 710 may be recessed to a predetermined depth at a central portion thereof, to thereby form the second recess R2 for receiving the preliminary acoustic absorbent F. As described herein, a pressure cover 800 may be positioned on the upper mold 700. Thus, the second recess R2 may have various shapes as long as the second recess R2 may provide an inner space sufficient for receiving the preliminary acoustic absorbent F and the pressure cover 800 may be efficiently combined with the upper mold 700. In the present example embodiment, the second recess R2 may have substantially the same shape as the first recess R1 except that no pillar may be provided in the second recess R2. However, the second recess R2 may have various shapes in view of extrusion efficiency of the preliminary acoustic absorbent F, as would be known to one of ordinary skill in the art.

The extrusion gate 730 may be arranged on the rear surface of the second mold body 710 and may be communicated with the second recess R2. The preliminary acoustic absorbent F may be extruded into the gap space S of the sound transfer part 100 or the upper space of the receiving space 622 through the extrusion gate 730, and thus the preliminary acoustic absorbent F may be accurately guided into the gap space S of the sound transfer part 100. For example, the extrusion gate 730 may be shaped into a reverse cone in which an upper portion adjacent to the second recess R2 may have a width or a diameter larger than a lower portion adjacent to the gap space S of the sound transfer part 100. A number of the extrusion gates 730 may be uniformly arranged along the ring-shaped receiving space 622.

Preferably, a ring-shaped protrusion 720 may be protruded from the rear surface of the second mold body 710 to a height h along the ring-shaped receiving space 622 of the first recess R1. When the upper mold 700 and the lower mold 600 may be combined with each other, the ring-shaped protrusion 720 may cover an upper portion of the gap space S of the sound transfer part 100. Thus, the thickness of the acoustic absorbent 200 in the gap space S may be determined by the height h of the ring-shaped protrusion 720.

While the present example embodiment discloses that the first recess R1 and the second recess R2 corresponds to each other by one to one, a singe second recess R2 may be connected to a plurality of the first recesses R1 in view of the process efficiency. In such a case, the preliminary acoustic absorbent F may be simultaneously extruded into a plurality of the first recesses R1 and the acoustic absorbent 200 may be simultaneously formed in the plurality of the sound transfer pars 100 by a single extrusion process of the preliminary acoustic absorbent F.

The preliminary acoustic absorbent F may include a mixture of solid state silicone (Si) and a thermally-decomposed foaming agent. The mixture may be provided in the second recess R2 and may be heated under a predetermined temperature, to thereby form the silicone foam in the second recess R2.

As described above, the adherence characteristics of urethane foam to the sound transfer part 100 may be deteriorated since the sound transfer part 100 may comprise silicone and thus the urethane foam may be easily separated from the sound transfer part 100. For minimizing the separation of the urethane foam from the sound transfer part 100, the protrusions or stepped portions may be needed at the hollow shaft 110. However, since the preliminary acoustic absorbent may comprise silicone and thus the acoustic absorbent 200 may comprise the same material of silicone (Si) as the external sheet 120 and the hollow shaft 110, the adherence characteristics between the acoustic absorbent 200 and both of the external sheet 120 and the hollow shaft 110 may be sufficiently improved in the ear tip 500 without any protrusions or the stepped portions, thereby improving the manufacturing efficiency of the ear tip 500.

The preliminary acoustic absorbent F may be extruded into the gap space S of the sound transfer part 100 through the extrusion gate 730 by the pressure cover 800. While the present example embodiment discloses that the preliminary acoustic absorbent F may be formed by a heat treatment to the mixture of the silicone and the foaming agent in the second recess R2, the ready-made silicone foam would be provided in the second recess R2, as would be known to one of the ordinary skill in the art.

Thereafter, the second mold body 710 and the first mold body 610 may be aligned in such a way that the extrusion gate 730 may be positioned over the gap space S of the sound transfer part 100 that may be secured to the first recess R1 of the lower mold 600. Then, the second mold body 710 may move downwards to the first mold body 610 until the upper surface of the first mold body 610 may make contact with the rear surface of the second mold body 710, to thereby combine the upper mold 700 with the lower mold 600.

The alignment of the first and the second mold bodies 610 and 710 may be performed on a basis of the extrusion gate 730 in order that the extrusion gate 730 may be positioned over the gap space S or the upper space of the receiving space 622. For example, the a first mark may be provided at an end portion of the extrusion gate 730 and a second mark may be provided at an end portion of the pillar 620, and the first and the second mold bodies 610 and 710 may be aligned with each other based on the first and the second marks.

When completing the alignment of the first and the second mold bodies 610 and 710, the second mold body 710 may move downwards to the first mold body 610 until the rear surface of the second mold body 710 may make contact with the upper surface of the first mold body 610, to thereby combine the upper mold 700 to the lower mold 600. Therefore, the extrusion gate 730 may be arranged over the gap space S in a ring shape around the pillar 620 of the first recess R1.

Particularly, when the protrusions 720 may be provided at the rear surface of the second mold body 710, the extrusion gate 730 may further penetrate through the protrusions 720 and further extend into an inside of the gap space S. Since the protrusion 720 may be protruded to a protrusion height h from the rear surface of the second mold body 710, the protrusion 720 may be inserted into the gap space S to a depth corresponding to the protrusion height h and thus the upper portion of the gap space S may be clogged with the protrusion 720 when the rear surface of the second mold body 710 may make contact with the first mold body 610. Since the extrusion gate 730 communicating with the second recess R2 may penetrate through the second mold body 710 and the protrusion 720, the extrusion gate 730 may also be inserted into the gap space S to the depth corresponding to the protrusion height h of the protrusion 720.

While the present example embodiment discloses that the upper mold 700 may move downwards to the stationary lower mold 600, the lower mold 600 would also move upwards to the stationary upper mold 700, as would be known to one of the ordinary skill in the art.

Thereafter, the preliminary acoustic absorbent F may be pressurized in the second recess R2 and may be extruded into the gap space S from the upper mold 700.

For example, the pressure cover 800 may be combined with the upper mold (step S400) and an extrusion pressure may be applied to the preliminary acoustic absorbent F, to thereby extrude the preliminary acoustic absorbent F into the gap space S of the sound transfer part 100 (step S500). The pressure cover 800 may include a pressure plate 810 and a pressurizing protrusion 820 that may be protruded from a rear surface of the pressure plate 810 and shaped according to the shape of the second recess R2.

The pressure cover 800 may be combined with the upper mold 700 in such a configuration that the rear surface of the pressure plate 810 may make contact with an upper surface of the second mold body 710, and thus the pressurizing protrusion 820 may be inserted into the second recess R2 of the second mold body 710. Accordingly, the preliminary acoustic absorbent F may be uniformly pressurized in the second recess R2 by the pressurizing protrusion 820.

In an example embodiment, the pressurizing protrusion 820 may include a heat generator (not illustrated) for heating the mixture of the silicone and the foaming agent in the second recess R2 and the pressure plate 810 may include a hydraulic system for transferring the extrusion pressure to the pressurizing protrusion 820 and a power system for supplying an electronic power to the heat generator. When completing the combination of the pressure cover 800 and the upper mold 700, the mixture of the silicone and the foaming agent may be heated in the second recess R2 by the heat generator, to thereby form the silicone foam in the second recess R2. Then, the silicone foam may be extruded into the gap space S through the extrusion gate 730 under the extrusion pressure applied by the hydraulic system.

The pressure cover 800 and the upper mold 700 may be combined with each other by a fastening member such as a screw joint or a hydraulic joint, and thus the second recess R2 including the preliminary acoustic absorbent F may be sufficiently sealed from surroundings during the foaming process and the extrusion process. As described above, the mixture of the solid state silicone and the foaming agent may be transformed by the foaming process using the heat into the silicone foam such as a silicone rubber having a plurality of pores. While the present example embodiment discloses that the foaming process and the extrusion process are individually performed, the foaming process and the extrusion process would be simultaneously performed under some proper conditions. In such a case, the mixture of silicone and foaming agent may be formed into the silicone foam in the extrusion process into the gap space S.

In the present example embodiment, the amount of the foaming agent may be about 10% by weight to about 20% by weight relative to the weight of the solid state silicone in the mixture and the foaming process may be performed at a temperature of about 90° C. to about 110° C. under the pressure of about 5 atm to about 10 atm. The mixture of silicone and the foaming agent may be transformed to the preliminary silicone foam F having a plurality of pores through the foaming process. Since the preliminary acoustic absorbent F may comprise silicone in place of urethane, the adherence characteristics of the acoustic absorbent 200 in the gap space S to both of the external sheet 120 and the hollow shaft 110 may be sufficiently improved as compared when the acoustic absorbent 200 may include the conventional urethane foam, and thus the acoustic absorbent 200 may be prevented from being separated from the sound transfer part 100 without any protrusions or stepped portions on the hollow shaft 110.

In a modified example embodiment, a door (not illustrated) may be further provided on the upper portion of the extrusion gate 730 and thus the extrusion gate 730 may be selectively closed or opened in the second recess R2. For example, when the forming process may be performed in the second recess R2, the extrusion gate 730 may be closed by the door in the second recess R2. After completing the foaming process, the door may be open in the second recess R2 in such a way that the preliminary acoustic absorbent F may be extruded into the gap space S through the extrusion gate 730 in the extrusion process. When performing the extrusion process, the extrusion pressure may be controlled to be substantially the same as the pressure for the foaming process. However, the extrusion pressure different from the foaming pressure may be additionally applied to the preliminary acoustic absorbent F in the extrusion process for controlling an extrusion speed of the preliminary acoustic absorbent F. When the extrusion speed of the preliminary acoustic absorbent F may be excessively high, the external sheet 120 and the hollow shaft 110 may be damaged by the extruded preliminary acoustic absorbent F.

When the foaming process to the mixture of the silicone and the foaming agent and the extrusion process against the silicone foam may be performed simultaneously, the foaming process may be performed in the extrusion gate 730 and in the gap space S as well as the second recess R2. For that reason, the foaming pressure may be controlled in such a way that the extrusion gate 730, the external sheet 120 and the hollow shaft 110 may not be damaged in the foaming process. Particularly, the mixture ratio of the foaming agent and the foaming temperature may be controlled for preventing the damage to the extrusion gate 730, the external sheet 120 and the hollow shaft 110 in the foaming process.

When the extrusion pressure may be applied to the preliminary acoustic absorbent F by the pressure cover 800, the pressurizing protrusion 820 may squeeze toward the extrusion gate 730 and the preliminary acoustic absorbent F may be extruded into the gap space S through the extrusion gate 730. Thus, the gap space S of the sound transfer part 100 may be filled with the acoustic absorbent 200 including the silicone foam.

Particularly, when the ring-shaped protrusion 720 may be provided over the gap space S, the height of the acoustic absorbent 200 may be varied according to the protrusion height h of the ring-shaped protrusion 720. When the protrusion height h of the protrusion 720 may be relatively large and thus the protrusion 720 may be deeply inserted into the gap space S, the acoustic absorbent 200 may have a smaller height in the gap space S around a lower portion of the pod-shaped external sheet 120. In contrast, when the protrusion height h of the protrusion 720 may be relatively small and thus the protrusion 720 may be inserted into the gap space S around the upper portion thereof, the acoustic absorbent 200 may have greater height in the gap space S and most of the gap space S may be filled up with the acoustic absorbent 200. The height of the acoustic absorbent 200 may be varied in accordance with market requirements and usage environmental conditions of the ear tip.

After completing the formation of the acoustic absorbent in the gap space S, the upper mold 700 may be separated from the lower mold 600 (step S600).

For example, the fastening member between the pressure cover 800 and the upper mold 700 may be unfastened and the pressure cover 800 may be separated from the upper mold 700, and then the upper mold 700 may also be separated from the lower mold 600. The pressure cover 800, the upper mold 700 and the lower mold 600 may be simultaneously separated from one another, or may be separated from each other in the order named from the lower mold 600.

The extrusion process may be automatically terminated after a predetermined extrusion time and the acoustic absorbent 200 may be kept in the assembly of the upper mold 700 and the lower mold 600 for a predetermined dry time. After the dry time, the upper mold 700 may be separated from the lower mold 600. For example, the silicone foam in the gap space S may be dried for about 10 minutes to about 30 minutes under a room temperature and an atmospheric pressure. A sufficient dry process may minimize the adherence of the acoustic absorbent 200 to the upper mold 700. Particularly, when the ring-shaped protrusion 720 may comprise a metal or a plastic material, the upper mold 700 may be separated from the lower mold 600 without any residuals of the silicone foam on the surface of the ring-shaped protrusion 720. Accordingly, the acoustic absorbent 200 may be directly formed in the gap space S of the sound transfer part 100.

In a modified example embodiment, the lower mold 600 may be separated from the upper mold 700 while the upper mold 700 may still be combined with the pressure cover 800. For example, a sufficiently large amount of the preliminary acoustic absorbent F may be provided in the second recess R2 of the upper mold 700 and a series of the extrusion processes may be performed to a plurality of lower mold 600 in which the sound transfer part 100 is combined. That is, when a first extrusion process may be completed to a first lower mold to which a first sound transfer part may be combined, just merely the first lower mold may be separated from the assembly of the upper mold 700 and the pressure cover 800 and a second lower mold to which a second sound transfer part may be combined may be coupled to the assembly of the upper mold 700 and the pressure cover 800. Thus, a series of the extrusion process to a number of the sound transfer parts may be performed just by exchanging the lower mold 600 while maintaining the assembly of the upper mold 700 and the pressure cover 800, thereby improving the efficiency of the extrusion process.

Then, the sound transfer part 100 including the acoustic absorbent 200 may be separated from the lower mold 600, thereby forming the ear tip 500 having the silicone foam therein (step S700).

For example, the sound transfer part 100 including the acoustic absorbent 200 may be separated from the lower mold 600 by using the combining tool such as the combine zig, thereby forming the ear tip 500 in which the silicone foam may be prepared as the acoustic absorbent. The sound transfer part 100 including the acoustic absorbent 200 may also be manually separated from the lower mold 600 by an operator.

According to example embodiments of the present inventive concept, silicone foam is directly extruded into the gap space between the external sheet and the hollow shaft for the sound conduit of the ear tip and thus the acoustic absorbent is directly formed into the sound transfer part. Since the external sheet and the hollow shaft comprise silicone, the silicone foam is more adhered to the external sheet and the hollow shaft than the conventional urethane foam. In addition, the formation of the silicone foam in the sound transfer part does not require additional process for forming the silicone foam just like the conventional urethane foam, which reduces the manufacturing cost of the ear tip and improve the product reliability of the ear tip. Particularly, the sufficient adhesion between the silicone foam and the external sheet and the hollow shaft does not require the protrusions or the stepped portions for preventing the separation of the acoustic absorbent from the sound transfer part, which simplifies the manufacturing process of the ear tip.

Although the example embodiments of the present invention have been described, it is understood that the present invention should not be limited to these example embodiments but various changes and modifications can be made by one skilled in the art within the spirit and scope of the present invention as hereinafter claimed.

What is claimed is:

1. An ear tip comprising:

a sound transfer part including a hollow shaft and an external sheet, the hollow shaft having a cylindrical shape of which a circumferential surface is flat and providing a sound conduit for transferring audio signals and the external sheet being extended from an end portion of the hollow shaft in such a way that the hollow shaft is enclosed with the external sheet and a gap space is provided between the external sheet and the hollow shaft; and an acoustic absorbent making contact with the external sheet and the hollow shaft in the gap space and having a plurality of pores, the acoustic absorbent absorbing surrounding noises and preventing the surrounding noises from transferring into user's ear, wherein the acoustic absorbent includes silicone foam and the external sheet and the hollow shaft include a silicone rubber.

2. The ear tip of claim 1, wherein the hollow shaft and the external sheet have a hardness of 25° to 40° and the silicone foam has a hardness of 5° to 25°.

3. The ear tip of claim 1, wherein the hollow shaft and the external sheet have a hardness of 50° to 60° and the silicone foam has a hardness of 5° to 25°.

4. A method of manufacturing an ear tip, comprising:

forming a sound transfer part including a hollow shaft and an external sheet, the hollow shaft having a cylindrical shape of which a circumferential surface is flat and providing a sound conduit for transferring audio signals and the external sheet being extended from an end portion of the hollow shaft in such a way that the hollow shaft is enclosed with the external sheet and a gap space is provided between the external sheet and the hollow shaft;

combining the sound transfer part with a lower mold including at least a first recess in such a way that the gap space is exposed to surroundings;

combining an upper mold to the lower mold in such a way that the gap space is covered with the upper mold, the upper mold having a preliminary acoustic absorbent having a plurality of pores;

extruding the preliminary acoustic absorbent into the gap space of the sound transfer part by applying an extrusion pressure to the preliminary acoustic absorbent, thereby forming an acoustic absorbent in the gap space of the sound transfer part;

separating the upper mold from the lower mold, thereby exposing the sound transfer part having the acoustic absorbent; and separating the sound transfer part having the acoustic absorbent from the lower mold.

5. The method of claim 4, wherein combining the sound transfer part with the lower mold includes:

forming the lower mold to have a first plate-shaped mold body on which the first recess is prepared in such a way that a pillar is protruded from a central bottom of the first recess and a ring-shaped receiving space is provided around the pillar; and securing the sound transfer part into the first recess in such a way that the pillar is inserted into the hollow shaft of the sound transfer part and the external sheet is received in the receiving space around the pillar.

6. The method of claim 5, wherein the sound transfer part is secured into the first recess by a combine zig.

7. The method of claim 5, wherein a plurality of the first recesses is provided on the lower mold, so that a number of the sound transfer parts are simultaneously secured into the first recesses, respectively.

8. The method of claim 5, wherein combining the upper mold to the lower mold includes:

forming the upper mold to have a second plate-shaped mold body on which a second recess is provided correspondently to the first recess, the upper mold including at least an extrusion gate penetrating through the second mold body from a bottom of the second recess to a rear surface of the second mold body and communicating with the second recess;

supplying a mixture of solid state silicone and a thermally-decomposed foaming agent into the second recess of the second mold body;

aligning the second mold body with the first mold body in such a way that the extrusion gate is positioned over the gap space of the sound transfer part that is secured to the first recess of the first mold body; and moving the second mold body downwards to the first mold body until the rear surface of the second mold body makes contact with an upper surface of the first mold body.

9. The method of claim 8, wherein the upper mold is formed to further have at least a ring-shaped protrusion protruded from the rear surface of the second mold body along the ring-shaped receiving space of the first recess, and wherein the step of moving the second mold body downwards is performed until the ring-shaped protrusion is inserted into an upper portion of the gap space and thus an upper portion of the gap space is covered with the ring-shaped protrusion.

10. The method of claim 9, wherein the extrusion gate penetrates through both of the second mold body and the ring-shaped protrusion, so that the second recess is communicated with the extrusion gate.

11. The method of claim 8, wherein extruding the preliminary acoustic absorbent into the gap space includes:

combining a pressure cover including a pressure plate and a pressurizing protrusion protruded from a rear surface of the pressure plate with the upper mold in such a way that the pressurizing protrusion is inserted into the second recess of the upper mold;

forming silicone foam as the preliminary acoustic absorbent by performing a heat treatment to the mixture of the solid state silicone and the foaming agent in the second recess; and pressurizing the preliminary acoustic absorbent by the pressurizing protrusion, thereby extruding the preliminary acoustic absorbent into the gap space of the sound transfer part through the extrusion gate.

12. The method of claim 11, wherein the step of forming the silicone foam as the preliminary acoustic absorbent and the step of pressurizing the preliminary acoustic absorbent are simultaneously performed, so that the silicone foam is formed from the mixture while being extruded into the gap space.

13. The method of claim 5, wherein combining the upper mold to the lower mold includes:

forming the upper mold to have a second plate-shaped mold body on which a second recess is provided correspondently to the first recess, the upper mold including at least an extrusion gate penetrating through the second mold body from a bottom of the second recess to a rear surface of the second mold body and communicating with the second recess;

supplying silicone foam as the preliminary acoustic absorbent into the second recess of the upper mold body;

aligning the second mold body with the first mold body in such a way that the extrusion gate is positioned over the gap space of the sound transfer part that is secured to the first recess of the first mold body; and moving the second mold body downwards to the first mold body until the rear surface of the second mold body makes contact with an upper surface of the first mold body.

14. An ear phone comprising:

a housing including an audio signal generator;

a cover detachably coupled to the housing such that the housing is covered with the cover and an inner space of the housing is closed from surroundings, the cover including a sound guide through which the audio signal is discharged out of the closed inner space; and an ear tip detachably attached to the cover and guiding the audio signals into the user's ear;

wherein the ear tip includes a sound transfer part including a hollow shaft and an external sheet, the hollow shaft having a cylindrical shape of which a circumferential surface is flat and providing a sound conduit for transferring audio signals and the external sheet being extended from an end portion of the hollow shaft in such a way that the hollow shaft is enclosed with the external sheet and a gap space is provided between the external sheet and the hollow shaft; and an acoustic absorbent making contact with the external sheet and the hollow shaft in the gap space and having a plurality of pores, the acoustic absorbent absorbing surrounding noises and preventing the surrounding noises from transferring into user's ear, wherein the acoustic absorbent includes silicone foam and the external sheet and the hollow shaft include a silicone rubber.

15. The method of claim 14, wherein the sound guide is shaped into a tube having at least a recess and at least a protrusion at an end portion thereof and the hollow shaft of the ear tip includes a stepped unit having a receiving space in which the protrusion is received in such a configuration that the protrusion and the stepped unit makes surface contact with each other in an axial direction of the hollow shaft.

* * * * *